US011180970B2

(12) United States Patent
Main et al.

(10) Patent No.: US 11,180,970 B2
(45) Date of Patent: Nov. 23, 2021

(54) INSERTION OF A SEAL STINGER INTO A PACKER POSITIONED IN A WELLBORE TO FACILITATE STRADDLING A DAMAGED ZONE WITHIN THE WELLBORE

(71) Applicant: Halliburton Energy Services, Inc., Houston, TX (US)

(72) Inventors: Barry Richardson Main, Alford (GB); Ronald George Taylor, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 195 days.

(21) Appl. No.: 16/499,177

(22) PCT Filed: Dec. 18, 2018

(86) PCT No.: PCT/US2018/066333

§ 371 (c)(1),
(2) Date: Sep. 27, 2019

(87) PCT Pub. No.: WO2020/131042

PCT Pub. Date: Jun. 25, 2020

(65) Prior Publication Data

US 2021/0108481 A1 Apr. 15, 2021

(51) Int. Cl.
*E21B 23/06* (2006.01)
*E21B 33/124* (2006.01)

(52) U.S. Cl.
CPC ..... *E21B 33/124* (2013.01); *E21B 23/06* (2013.01)

(58) Field of Classification Search
CPC ..... E21B 23/06; E21B 33/124
See application file for complete search history.

(56) References Cited

U.S. PATENT DOCUMENTS 3,102,594 A * 9/1963 Crowe ..... E21B 23/006 166/125
3,517,743 A * 6/1970 Pumpelly ..... E21B 33/124 166/127
4,059,150 A * 11/1977 Manderscheid ..... E21B 23/06 166/120
4,237,979 A * 12/1980 Weise ..... E21B 23/06 166/120

(Continued)

OTHER PUBLICATIONS

PCT Application Serial No. PCT/US2018/066333, International Search Report, dated Sep. 18, 2019, 3 pages.

(Continued)

*Primary Examiner* — Kipp C Wallace
(74) *Attorney, Agent, or Firm* — Gilliam IP PLLC

(57) ABSTRACT

A lower packer, seal stinger, upper packer, running tool, and setting tool is positioned into the wellbore. A force is applied by the setting tool, which causes the seal stinger to be pushed into a seal receptacle of the lower packer. The seal stinger is pushed by pushing the running tool which causes the upper packer to be pushed which causes the seal stinger to be pushed. A force is also applied by an internal rod of the setting tool to pull the running tool which causes the running tool to hold the lower packer in place as the seal stinger is pushed into the seal receptacle. The running tool and setting tool is then removed from the wellbore, wherein the lower packer, seal stinger, and upper packer comprise the straddle assembly.

20 Claims, 8 Drawing Sheets

(56) References Cited

U.S. PATENT DOCUMENTS

| | | | | |
|---|---|---|---|---|
| 5,343,949 | A * | 9/1994 | Ross | E21B 17/07 166/278 |
| 5,373,906 | A * | 12/1994 | Braddick | E21B 7/061 175/61 |
| 5,377,750 | A * | 1/1995 | Arterbury | E21B 23/02 166/205 |
| 6,216,785 | B1 * | 4/2001 | Achee, Jr. | E21B 33/124 166/278 |
| 6,655,461 | B2 | 12/2003 | Eslinger et al. | |
| 7,228,912 | B2 | 6/2007 | Patel et al. | |
| 9,650,854 | B2 | 5/2017 | Devarajan et al. | |
| 2014/0209327 | A1 * | 7/2014 | Patel | E21B 33/12 166/387 |
| 2015/0218906 | A1 * | 8/2015 | Clem | E21B 43/04 166/105 |
| 2015/0376979 | A1 | 12/2015 | Mitchell et al. | |
| 2016/0123114 | A1 | 5/2016 | Flores | |
| 2016/0376869 | A1 * | 12/2016 | Rochen | E21B 34/063 166/135 |

OTHER PUBLICATIONS

PCT Application Serial No. PCT/US2018/066333, International Written Opinion, dated Sep. 18, 2019, 4 pages.

* cited by examiner

INSERTION OF A SEAL STINGER INTO A PACKER POSITIONED IN A WELLBORE TO FACILITATE STRADDLING A DAMAGED ZONE WITHIN THE WELLBORE

TECHNICAL FIELD

The disclosure generally relates to the field of earth or rock drilling (mining), and more particularly to insertion of a seal stinger into a packer positioned in a wellbore to facilitate straddling a damaged zone within the wellbore for extraction of hydrocarbon from a reservoir in a geologic formation.

BACKGROUND ART

A wellbore is drilled in a geologic formation to facilitate extraction of hydrocarbon from a reservoir in the geologic formation to the surface. The wellbore is typically lined with a casing such as steel pipe cemented in place in the wellbore. The casing serves multiple purposes. The casing prevents the wellbore from caving in, keeps hydrocarbon carried within the casing from escaping out of the casing, and prevents unwanted fluids such as water outside of the casing from entering into the casing and contaminating the hydrocarbon carried within the casing.

A zone of a casing in the wellbore can be damaged by a chemical reaction such as corrosion or be physically damaged. The corrosion or physical damage causes holes in the casing. The holes result in the hydrocarbon carried within the casing leaking outside the casing and/or water in the geologic formation entering the casing. The damage impacts a quantity and quality of the hydrocarbon carried in the casing from the reservoir to the surface of the geologic formation. To bypass a damaged zone of a casing of the wellbore, a straddle assembly is positioned in the wellbore. The straddle assembly allows hydrocarbon to be carried from the reservoir to a surface without leaking into the geologic formation or being contaminated by unwanted fluids entering the casing.

BRIEF DESCRIPTION OF THE DRAWINGS

Embodiments of the disclosure may be better understood by referencing the accompanying drawings.

DESCRIPTION OF EMBODIMENTS

Figure 1:
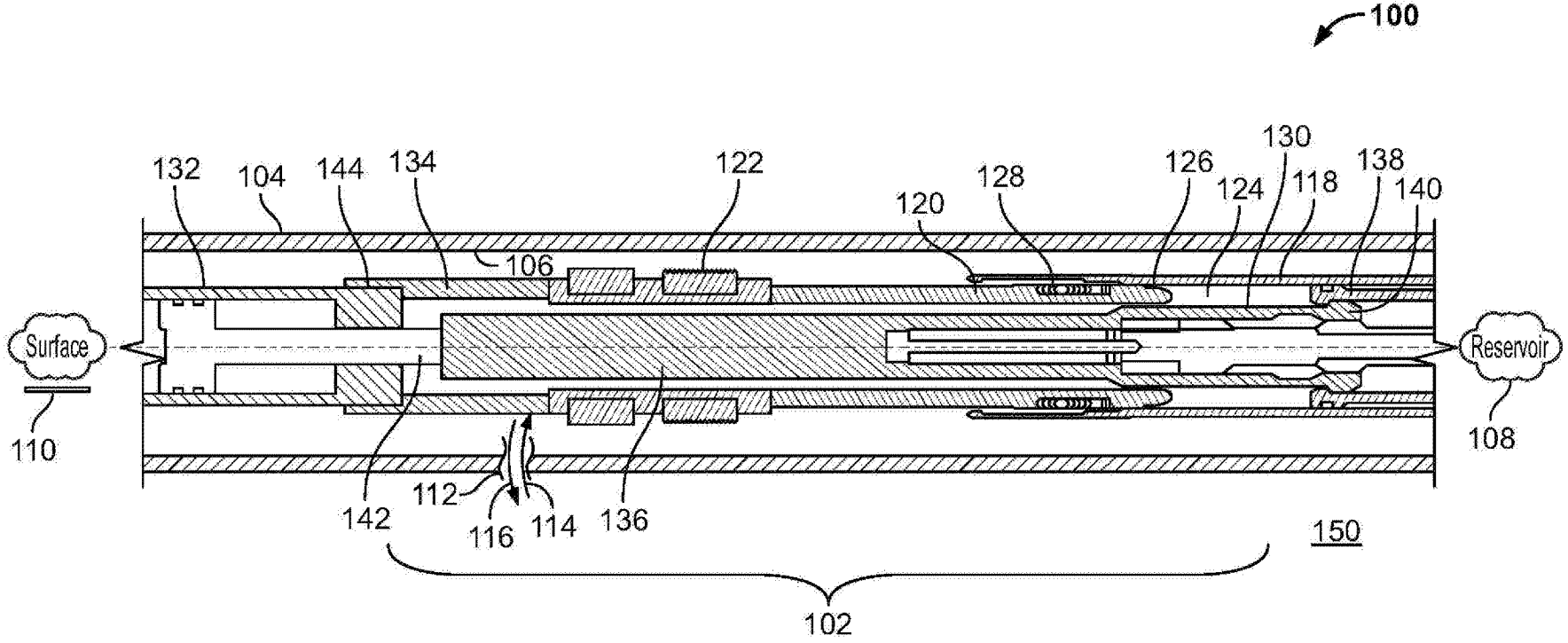
FIG. 1 illustrates a cross section of an example straddle assembly in a wellbore.

The description that follows includes example systems, methods, techniques, and program flows that embody embodiments of the disclosure. However, it is understood that this disclosure may be practiced without these specific details. For instance, this disclosure refers to insertion of a seal stinger into a packer positioned in a wellbore to straddle a damaged zone in the wellbore in illustrative examples. Embodiments of this disclosure can instead be applied to straddle zones other than in a wellbore. In other instances, well-known instruction instances, protocols, structures and techniques have not been shown in detail in order not to obfuscate the description.

Overview

A straddle assembly includes two wellbore packers positioned within the casing of the wellbore connected together via a seal stinger. The two wellbore packers include a lower packer and an upper packer. The lower packer is positioned along the casing below the zone to be isolated. Then, an upper packer and seal stinger is lowered, and the seal stinger is positioned into a seal receptacle of the lower packer. The seal stinger is typically a tapered hollow tube which is designed to be received by the seal receptacle. A wellbore tractor lowers a wellbore stroker in the wellbore which applies a jarring force in an axial direction of the wellbore to push the seal stinger into the lower packer. The jarring force is a force applied to the seal stinger overcome seal friction between the seal receptacle and the seal stinger. The jarring can be several thousand pounds of force applied multiple times to the seal stinger to force the seal stinger into the seal receptacle. Then, a ram already lowered into the wellbore with the upper packer and seal stinger pushes the upper packer to set the upper packer above the lower packer. In this regard, the straddle assembly isolates the damaged zone such that hydrocarbon flows from below the lower packer, through the lower packer, the seal stinger, upper packer, and to a surface of the formation bypassing the damaged zone without leaking into the geologic formation or being contaminated by formation fluid entering the wellbore.

The jarring process to push the seal stinger into the lower packer increases a chance that one or more of the lower packer, seal receptacle, or seal stinger is damaged as the straddle is positioned in the wellbore. Additionally, the positioning of the straddle requires using a ram to set the upper packer after the stroker pushes the seal stinger into the lower packer. The use of the ram along with the stroker adds to a complexity associated with positioning the straddle in the wellbore.

Embodiments described herein are directed to positioning the straddle in the wellbore without the impulse forces needed to jar the seal stinger into the seal receptacle. A lower packer, an upper packer, a seal stinger, a setting tool, and a running tool are run into the wellbore. The running tool has a latch on an internal rod of the running tool which engages a shoulder of the lower packer. Based on this engagement, the running tool is anchored to the lower packer and cannot be pulled out. A ram of the setting tool is extended producing a force which pushes the running tool further downhole. In turn, the pushing of the running tool causes the upper packer to be pushed which causes the seal stinger to be pushed into a seal receptacle of the lower packer. The force by the ram extending also causes a force to be applied to an internal rod of the setting tool and internal rod of running tool. The force on the internal rod of the setting tool pulls the internal rod of the running tool which causes the internal rod of the running tool to pull the lower packer holding it in place because the running tool is anchored to the lower packer, while the seal stinger is pushed in to the seal receptacle. In this regard, the seal stinger is pushed into the seal receptacle of the lower packer rather than being jarred in as the ram extends. This avoids damage to one or more of the setting tool, seal stinger, and lower packer, among other components saving lost time due to the damage. Also, the arrangement allows for deeper positioning of the straddle downhole because less force is needed to seat the seal stinger in the lower packer.

Embodiments described herein are also directed to using the ram to set the upper packer at a same time the seal stinger is pushed into the seal receptacle. The ram has a long stroke. After the seal stinger is pushed into the seal receptacle, the ram further pushes the running tool and upper packer to set the upper packer as part of the same stroke. Then, the upper packer is set in the wellbore. In this regard, the ram facilitates pushing of the seal stinger in the seal receptacle and setting of the upper packer in the casing without requiring a separate wellbore tractor or wellbore stroker to perform this function.

The description that follows includes example systems, apparatuses, and methods that embody aspects of the disclosure. However, it is understood that this disclosure may be practiced without these specific details. In other instances, well-known structures and techniques have not been shown in detail in order not to obfuscate the description.

Example Illustrations

FIG. 1 illustrates a ½ cross section of an example straddle assembly 100 arranged within a zone 102 of a wellbore 104 drilled in a geologic formation 150. The wellbore 104 is shown to be horizontal but could also be vertical or some other orientation. The straddle assembly 100 is illustrated with shading to indicate different components of the straddle assembly 100, where same shading typically indicates the same component.

The wellbore 104 is typically lined with a casing 106 such as a pipe cemented in place in the wellbore 104 to facilitate carrying hydrocarbon from a reservoir 108 downhole in the geologic formation 150 to a surface 110 of the geologic formation 150. The zone 102 may be a contiguous region of the wellbore 104. In some instances, the casing 106 in the zone 102 may be physically damaged or corroded. The corrosion or physical damage causes holes 112 in the casing. The holes 112 result in water, for example, in the geologic formation entering the wellbore as shown by arrow 114 and/or the hydrocarbon carried within the casing leaking outside the wellbore as shown by arrow 116.

The straddle assembly 100 may be arranged to span the zone 102 so that hydrocarbon from the reservoir 108 flows though the straddle assembly 100 in the zone 102. By flowing the hydrocarbon through the straddle assembly 100, hydrocarbon loss out of the casing 106 and contamination of the hydrocarbon by the water entering the casing 106 is reduced.

The straddle assembly 100 may include a lower packer 118, seal stinger 120, and upper packer 122. The lower packer 118 is a device run into the casing 106 of the wellbore 104 which initially has an outside diameter which is smaller than the casing 106 to allow for running the lower packer 118 into the casing 106 below the zone 102 to be isolated. The lower packer 118 is set by being expanded or extended radially outwards for engagement with the casing 106 such that anchor slips (not shown) associated with the lower packer bites into the casing 106 so that the lower packer 118 is set in place. More particularly, the lower packer 118 is compressed longitudinally within casing 106 to cause lateral expansion of the lower packer 118 with sufficient pressure to seal against the casing 106. The lower packer 118 may have an expandable elastomeric element such as a bladder which is pumped with fluid to expand the lower packer 118. The expansion of the bladder results in the lower packer 118 being secured against the casing 106 to create a reliable hydraulic seal against the casing 106.

The lower packer 118 may have a seal receptacle 124 with an opening facing toward the surface 110. The seal receptacle 124 may be a polished bore in the lower packer 118 which accepts the seal stinger 120. The seal stinger 120 is a hollow conduit with a lead in bullnose 126 and a set of seals 128 such as o-rings which when inserted into the seal receptacle 124 provides pressure sealing. The seal stinger 120 is positioned in the seal receptacle 124 via a setting tool 132, running tool 130, and the upper packer 122. The running tool 130 is an adapter between the setting tool 132 and the upper packer 122. The running tool 130 has a collar 134 and an internal rod 136. The internal rod 136 may be hollow or solid and span a longitudinal distance of the wellbore. The collar 134 may be arranged around at least a portion of a circumference of the internal rod 136. One end of the internal rod 136 of the running tool 130 has a latch 138 which locks against a shoulder 140 of the lower packer 118. Another end of the internal rod 136 of the running tool 130 may be threaded and arranged to couple to a mating internal rod 142 of the setting tool 132. The internal rod 142 may be hollow or solid and span a given longitudinal distance of the wellbore. The collar 134 of the running tool 130 may also be threaded and arranged to couple to a mating collar 144 of the setting tool 132. The collar 144 may be arranged around a portion of the circumference of the internal rod 142. Reference 132 also points to a ram of the setting tool which extends toward the reservoir 108 such that the collar 144 slides over the internal rod 142 while the internal rod 142 moves in a direction opposite to the extension of the ram. The setting tool 132 causes the seal stinger 120 to be seated in the seal receptacle 124 and the upper packer 122 to be set as part of the extension of the ram and without jarring. Further, after removing the setting tool 132 and running tool 130 from the wellbore 104, the lower packer 118, seal stinger 120, and upper packer 122 straddles the damaged zone 102 of the wellbore 104 and facilitates flow of hydrocarbon from the reservoir 108 below the lower packer 118, through the lower packer 118, into the seal stinger 120, through the upper packer 122 and to the surface 110, bypassing the zone of casing which may be damaged.

FIGS. 2A to 2E illustrates a sequence of events associated with forming the straddle assembly in a wellbore. The straddle assembly may be formed via the setting tool, running tool, upper packer, seal stinger, and lower packer. For simplicity, a ¼ cross sectional view of the straddle assembly with respect to a longitudinal line of symmetry is shown rather than the ½ cross sectional view shown in FIG. 1. The straddle assembly may be positioned below a surface of the geologic formation to facilitate extraction of hydrocarbon from a reservoir in the geologic formation.

Figure 2A:
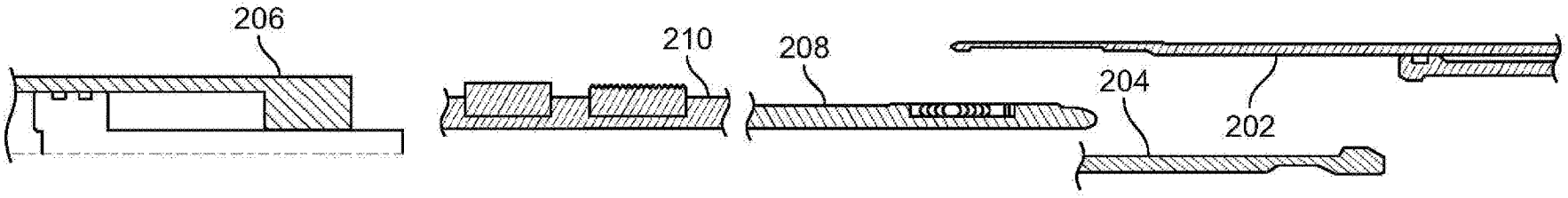
FIGS. 2A to 2E illustrates a sequence of events associated with forming the example straddle assembly the wellbore.

In FIG. 2A, portions of various components associated with forming the straddle assembly is shown. The components include a lower packer 202, an end of the running tool 204, setting tool 206, seal stinger 208, and upper packer 210 which were shown and described with respect to FIG. 1.

Figure 2B:
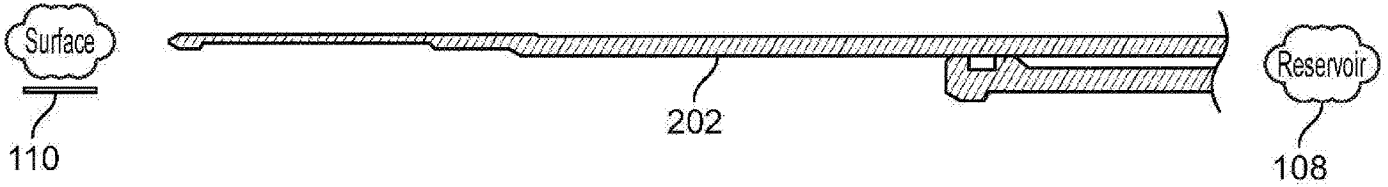

In FIG. 2B, a lower packer 202 is positioned in the wellbore below the zone of the wellbore to be isolated. For example, a braided wire or e-line may be used to lower the lower packer 202 into the wellbore. The braided wire is a multiple strand wire braided to form a single cable. Electric line (e-line) is a multiple strand wire armor cable wrapped around a single conductor. The lower packer 202 may be lowered into the wellbore in other ways as well.

The lower packer 202 may be set in the wellbore by being expanded or extended radially outwards for engagement with the casing of the wellbore. More particularly, the lower packer 202 is compressed longitudinally within the wellbore to cause lateral expansion of the packing element with sufficient pressure for anchor slips of the lower packer to bite and seal against the casing.

Figure 2C:
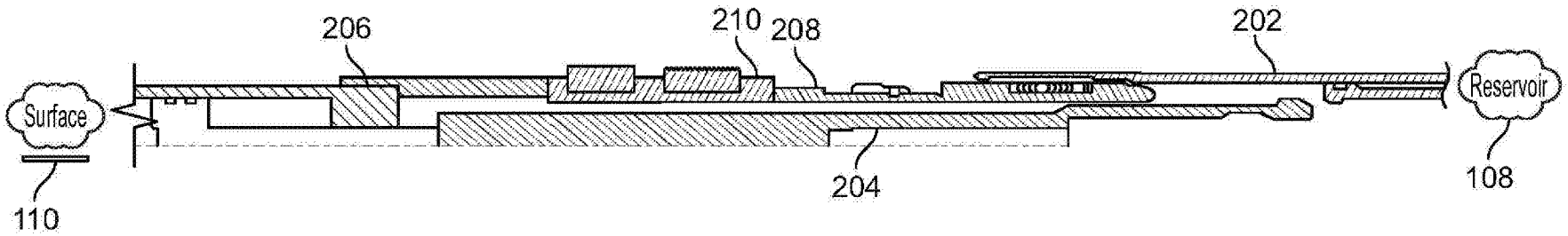

In FIG. 2C, a seal stinger 208, upper packer 210, running tool 204, and setting tool 206 may then be lowered into the wellbore. For example, a braided wire or e-line may be used to lower the seal stinger 208, upper packer 210, running tool 204, and setting tool 206 into the wellbore. One or more of the components may be coupled together and lowered such as the upper packer 210 and the seal stinger 208 or lowered separately into the wellbore. The seal stinger 208 may straddle the zone to be isolated from the lower packer 202 to the upper packer 210.

Figure 2D:
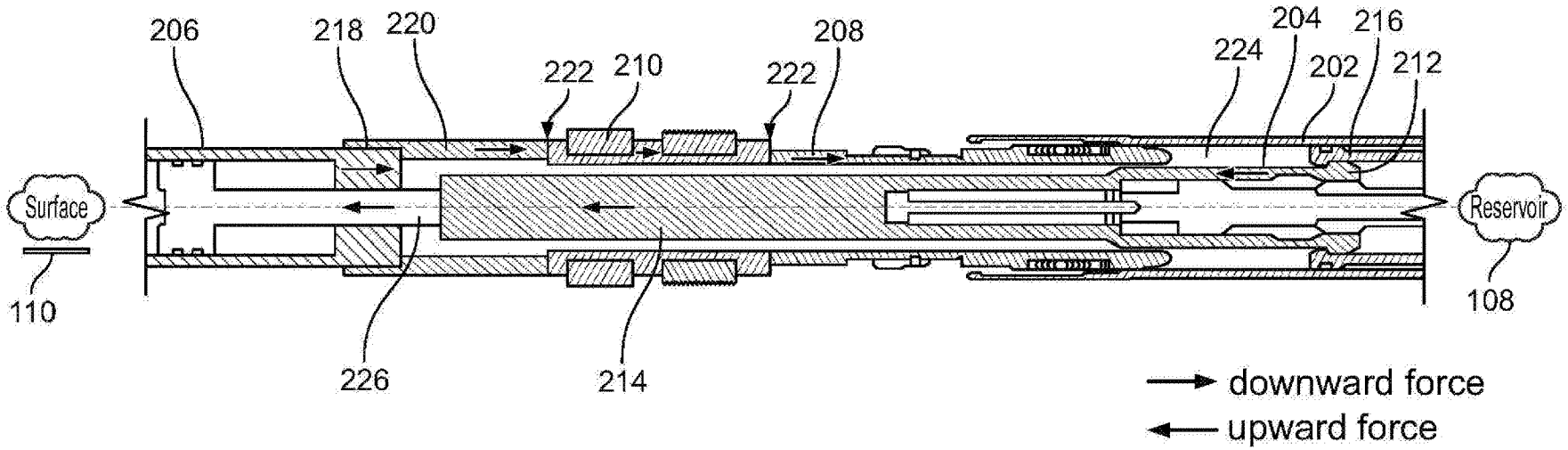

In FIG. 2D, a latch 212 of the internal rod 214 of the running tool 204 is positioned to engage a shoulder 216 of the lower packer 202. The latch 212 engaging the shoulder 216 prevents the running tool 204 from being pulled out of the lower packer 202 by an upward force, i.e., the running tool is anchored in the lower packer 202. The latch 212 and shoulder 216 arrangement for anchoring the running tool to the lower packer 202 is exemplary in nature. Other structures may also be used providing the anchoring as well.

A first force may be then applied by the setting tool 206. A ram of the setting tool (also shown by reference 206) may be coupled to a motor powered by a downhole power unit (DPU) such as a battery which causes the ram to extend in the direction downhole to the reservoir causing the first force. The first force may be a downward force in a direction away from the surface and toward the reservoir which is applied to the collar 218 of the setting tool 206 which in turn causes the collar 220 of the running tool 204 which is threaded onto collar 218 of the setting tool 206 to be pushed toward the upper packer 210. The collar 220 of the running tool 204 may be pushed to contact the upper packer 210 at 222 which in turn pushes at 222 the seal stinger 208 into the seal receptacle 224 of the lower packer 202 to form a pressure seal. The internal rod 214 of the running tool 204 may be anchored to the lower packer 202 at the latch 212 on one side and on the other side threaded to the internal rod 226 of the setting tool 206. The extension of the ram may cause a second force to be applied to the internal rod 226 of the setting tool 206 and the running tool 204. In one or more examples, the second force is an opposing force to the first force which continues to be applied as the ram extends. The second force may be an upward force in a direction toward the surface 110 and away from the reservoir 108. This upward force on the internal rod of the setting tool pulls the internal rod of the running tool which in turn pulls the lower packer 202 because the internal rod 214 of the running tool 204 is anchored to the lower packer 202 at the latch 212. In this regard, the seal stinger 208 is pushed into the seal receptacle 224 and at the same time the pulling of the lower packer 202 holds the lower packer 303 in place, resulting in the seating of the seal stinger 208 into the seal receptacle 224. The pulling and pushing allows for seating the seal stinger 208 into the seal receptacle 224 without having to jar the seal stinger into the seal receptacle.

Figure 2E:
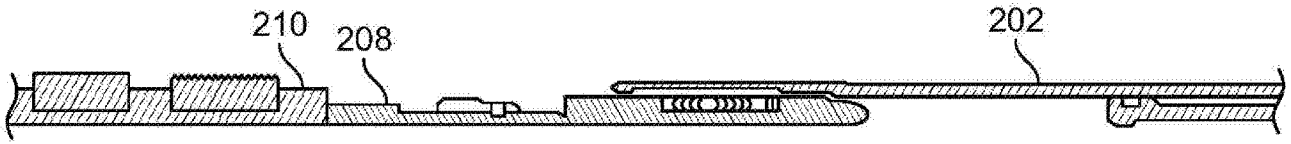

In FIG. 2E, the upper packer 210 is set. The ram may have a long stroke. The stroke associated with seating the seal stinger 208 into the seal receptacle 224 continues with setting the upper packer 210 in the casing. The upper packer 210 may be expanded or extended radially outwards for engagement with the casing of the wellbore. Then, the running tool and setting tool is removed from the wellbore leaving the seal stinger 208 and lower packer 202 in the wellbore. The upper packer 210, lower packer 202, and seal stinger 208 define a conduit for allowing hydrocarbons to flow from the reservoir to the surface of the geologic formation.

A shear ring may lock the latch in place in an axial direction along the wellbore. To remove the running tool and setting tool from the wellbore, a predefined load is applied to a shear ring around a mandrel of the running tool such as its internal rod. When the predefined load is applied to the shear ring, the shear ring will break, resulting in the latch no longer being supported and anchored to the lower packer. The predefined load to shear the shear ring may be 50,000 pounds of force. The shearing of the shear ring allows the running tool and setting tool to be removed from the wellbore.

Figure 3A:
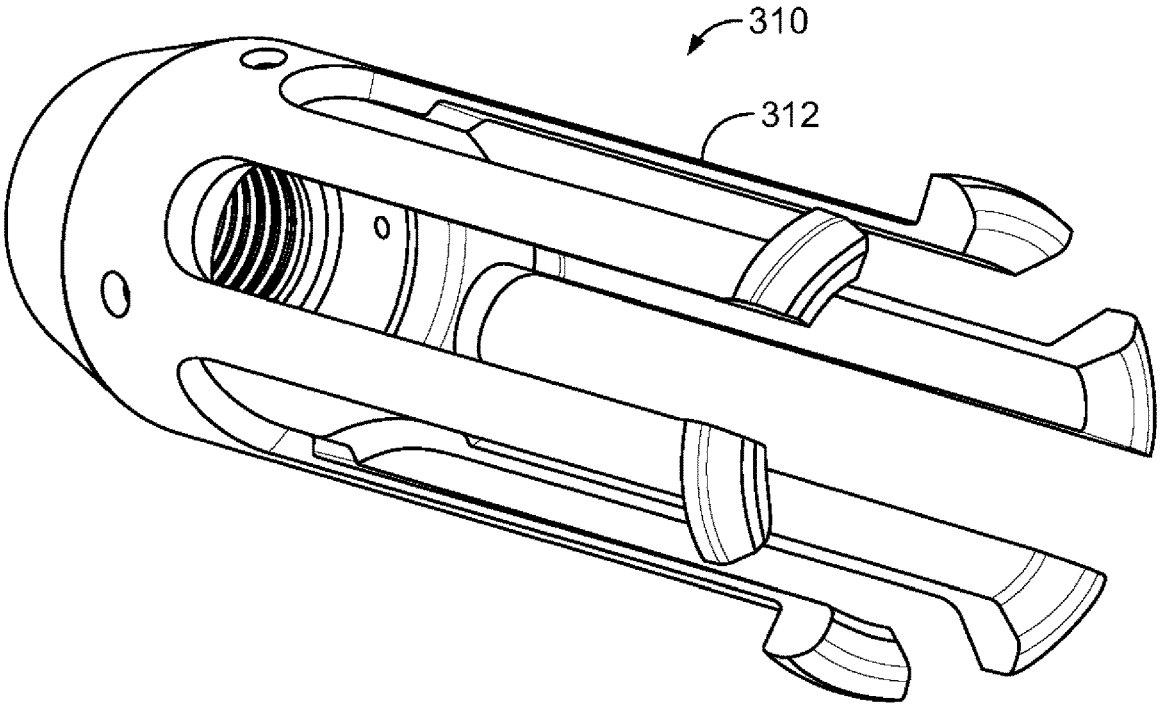
FIG. 3 shows a three-dimensional example of a shear ring and latch.
Figure 3B:
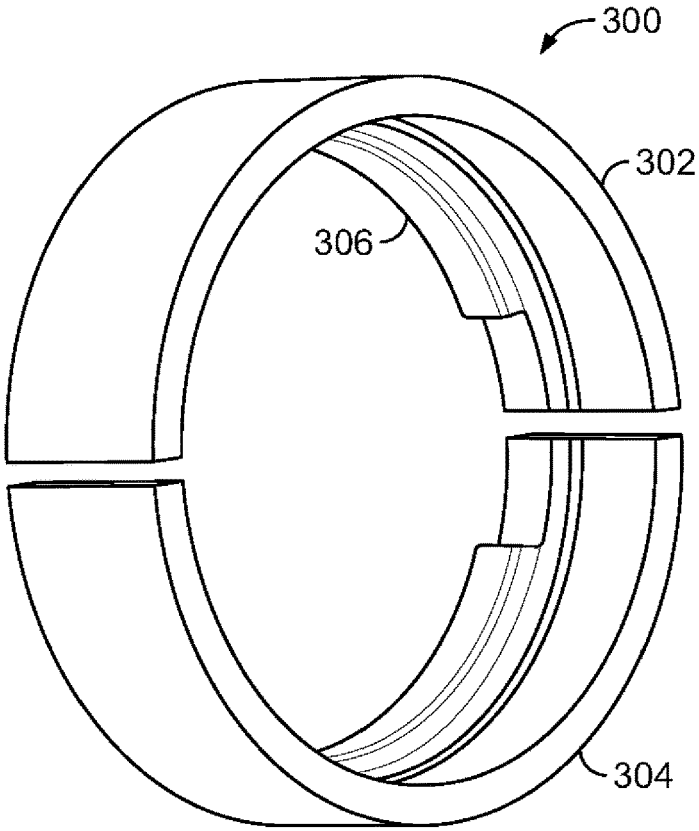

FIG. 3 shows a three-dimensional example of a shear ring and latch structure. The shear ring 300 is composed to two sections 302, 304 and an inner ring 306 which is sheared. Also, shown is a three-dimensional example of a latch structure 310. The latch structure 300 includes a plurality of latches 312 arranged in a circle.

Figure 4:
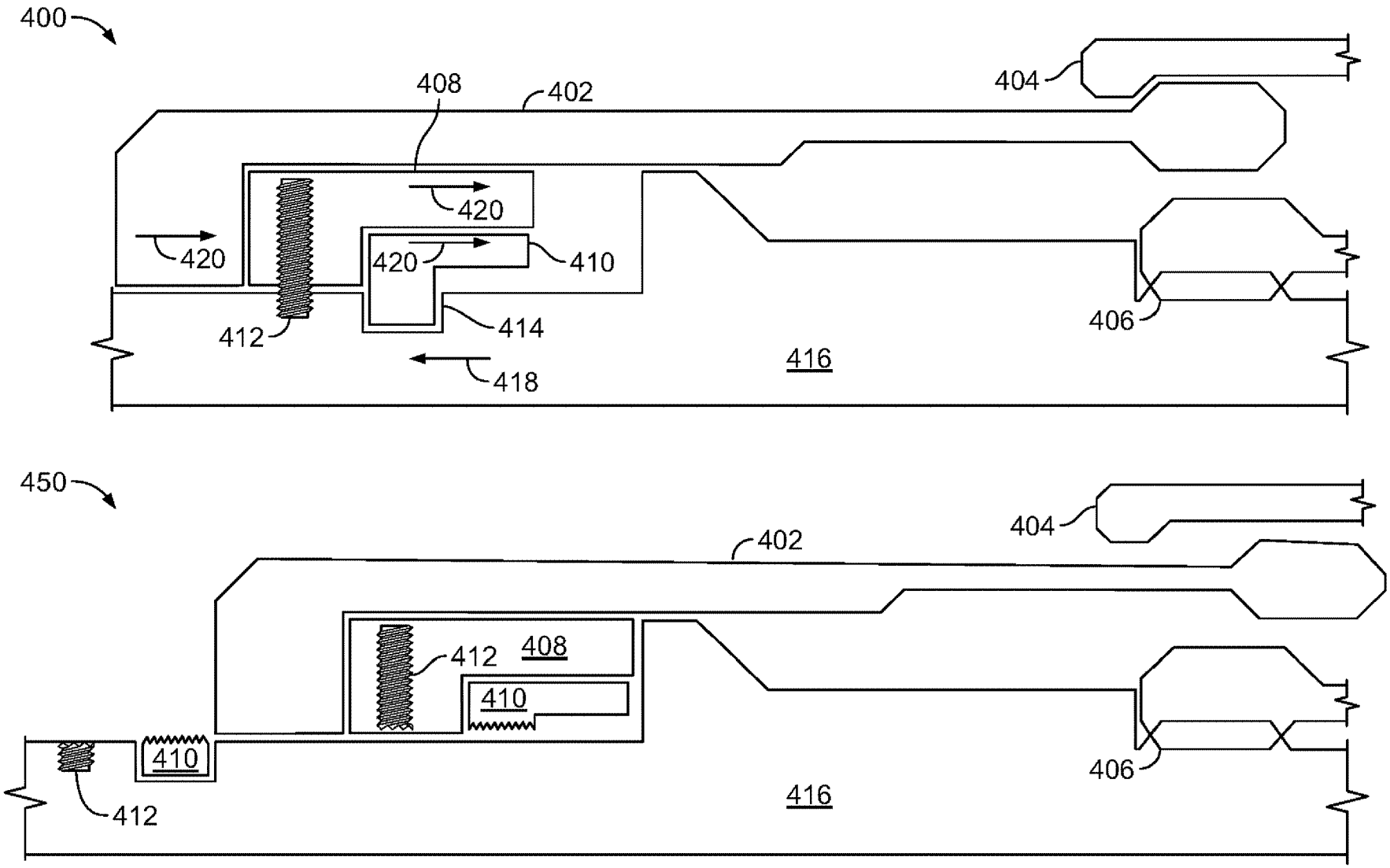
FIG. 4 illustrates a process for shearing the shear ring.

FIG. 4 illustrates a process for shearing the shear ring to facilitate removing the running tool and setting tool from the wellbore. The process is illustrated as arrangement 400 which shows the shear ring before shearing and arrangement 450 which shows the shear ring after shearing.

Arrangement 400 includes a latch 402, shoulder 404 of the lower packer, a latch support 406 for supporting the latch 402, and mandrel 416. The shear ring may be positioned under the latch 402. The shear ring is shown as a shear ring housing 408 associated with an outer diameter of the shear ring and an inner ring 410 which shears. The shear ring housing 408 may correspond to the sections 302 and 304 in FIG. 3 and the inner ring 410 may correspond to the inner ring 306 in FIG. 3. The shear ring housing 408 and inner ring 410 may be coupled together to form an integrated structure. A shear screw 412 may fix the shear ring housing 408 along the mandrel 416. Further, the inner ring 410 may be positioned in groove 414 along the mandrel 416. The positioning of the shear ring housing 408 and inner ring 410 along the mandrel 416 positions the latch 402 at the shoulder 404 of the lower packer.

Arrangement 450 shows a result of a shearing action which shears the inner ring 410 from the shear ring housing 408 and shear screw 412. The shearing action is as a result of application of loads 418, 420 shown by the arrows. The load 420 includes the pulling of the internal rod (mandrel 416) by the setting tool and opposing load 418 on the latch 402, shear screw 412, shear ring housing 408, shear ring 410 due to the pushing of the seal stinger into the seal receptacle into the lower packer, the lower packer being set in the casing via the anchoring slips on the lower packer, and transfer of load to the latch 402, shear screw 412, shear ring housing 408, and shear ring 410. When the difference in load 420 and 418 exceeds a threshold amount, a shearing occurs causing the latch 402 to be no longer supported by the latch support 406 and no longer engaged with the shoulder 404. The running tool and the setting tool may be then removed from the wellbore because it is no longer anchored to the lower packer. The tools may be removed to the surface using a braided wire and/or e-line, leaving the upper packer, seal stinger, and lower packer downhole to straddle the zone.

Figure 5:
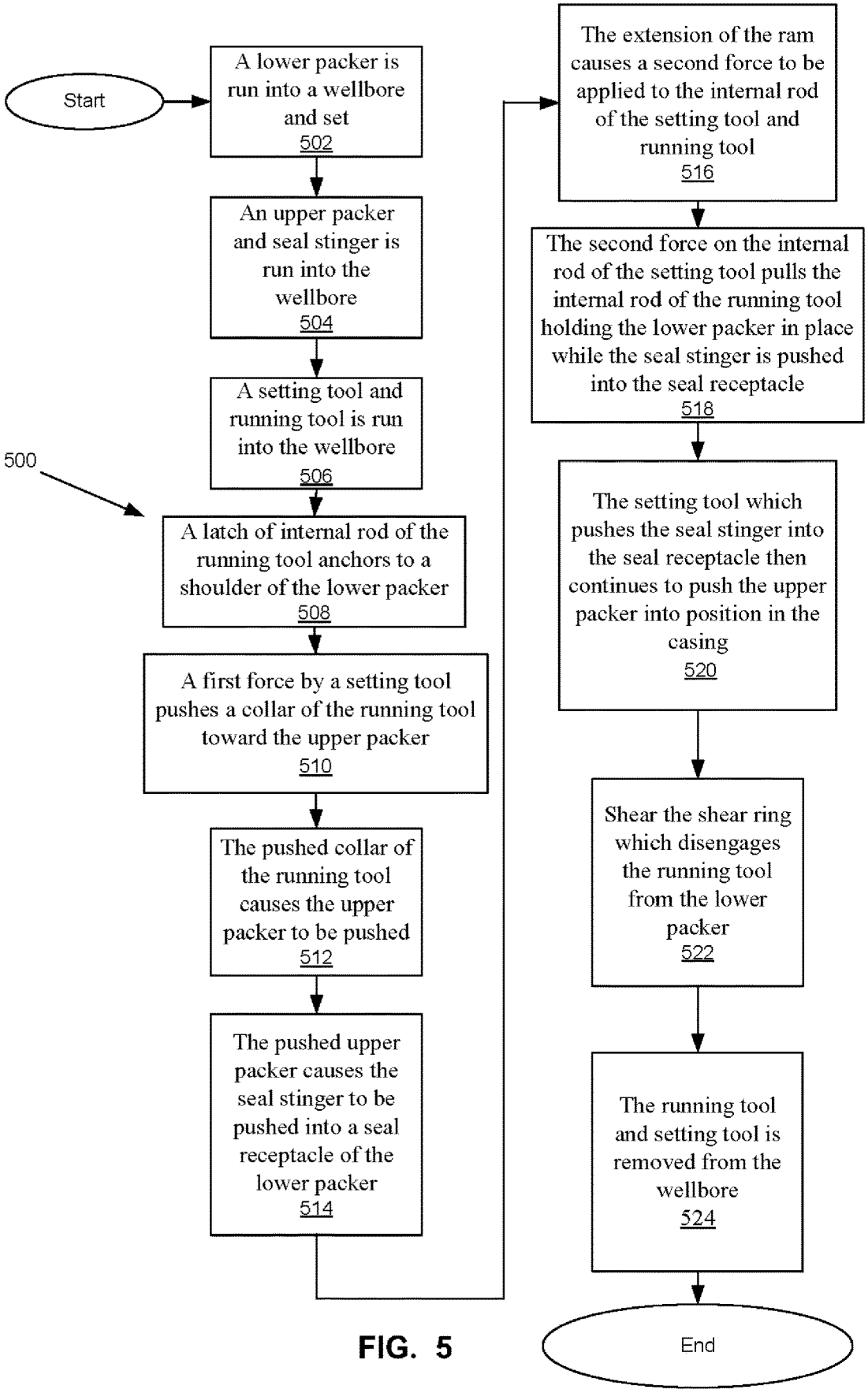
FIG. 5 is a flowchart of functions associated with forming the example straddle assembly in the wellbore.

FIG. 5 is a flowchart 500 of functions performed with one or more of the setting tool, running tool, upper packer, seal stinger, and lower packer to form a straddle which isolates a zone of a casing in the wellbore.

At 502, a lower packer is run into a wellbore and set. For example, the lower packer may be lowered into the wellbore via a braided line or e-line. The lower packer may be expanded to be secured in the casing of the wellbore. At 504, an upper packer and seal stinger is run into the wellbore. For example, the upper packer and seal stinger, separately, or together, may be lowered into the wellbore via a braided wire or e-line and positioned adjacent to the lower packer. At 506, a setting tool and running tool is run into the wellbore. For example, the setting tool and running tool may be lowered into the wellbore via a braided line or e-line. At 508, a latch of the running tool anchors to a shoulder of the lower packer. Based on this engagement, the running tool cannot be pulled out of the lower packer. At 510, a first force by a setting tool pushes a collar the running tool toward the upper packer. The first force may result from extension of a ram of the setting tool toward the reservoir downhole. At 512, the pushing of the collar of the running tool causes the upper packer to be pushed. At 514, the pushed upper packer causes the seal stinger to be pushed into a seal receptacle of the lower packer. At 516, the extension of the ram causes a second force to be applied to the internal rod of the setting tool and running tool because the running tool is anchored to the lower packer. In one or more examples, the second force is an opposing force to the first force which continues to be applied as the ram extends. At 518, the second force on the internal rod of the setting tool pulls the internal rod of the running tool which is anchored to the lower packer, holding the lower packer in place while the seal stinger is pushed into the seal receptacle. At 520, the setting tool which pushes the seal stinger into the seal receptacle then continues to push the upper packer to complete positioning of the upper packer in the casing. The upper packer is then set in the casing. This way the seal stinger is pushed into the seal receptacle and the upper packer is set in a same motion in a same direction, e.g., single extension of the ram of the setting tool in a downhole direction. At 522, a shearing force is applied to a shear ring which disengages the running tool and setting tool from the lower packer. At 524, the running tool and setting tool is removed from the wellbore, leaving the lower packer, seal stinger, and upper packer downhole.

Figure 6:
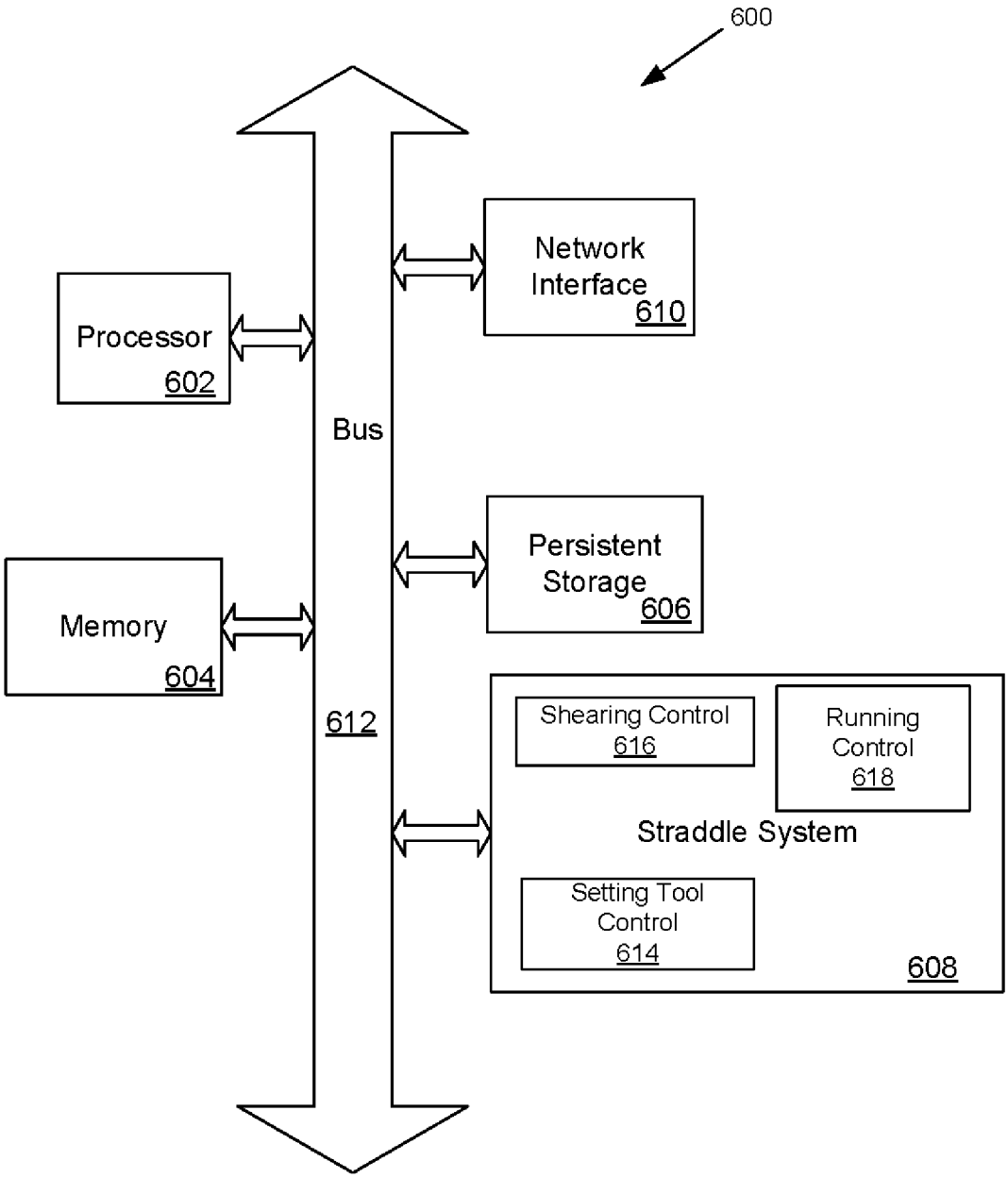
FIG. 6 is a block diagram of a computer system associated with forming the example straddle assembly in the wellbore.

FIG. 6 is a block diagram of a computer system 600 for positioning the straddle assembly in the wellbore. The computer system 600 may be located at a surface of a formation or downhole and in communication with the tool. In the case that the computer system 600 is downhole, the computer system 600 may be rugged, unobtrusive, and can withstand the temperatures and pressures in situ at the wellbore.

The computer system 600 includes various components including a processor 602, memory 604, persistent data storage 606, straddling system 608, network interface 610, and bus 612. The processor 602 may be one or multiple processors, multiple cores, multiple nodes, and/or implementing multi-threading, etc.). The memory 604 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.). The persistent data storage 606 can be a hard disk drive, such as magnetic storage device. The straddling system 608 facilitates performing functions described herein for positioning one or more of the setting tool, running tool, upper packer, seal stinger, and lower packer to straddle a zone of the wellbore. The straddling position system includes various functions including setting tool control 614 for controlling operation of the ram, shearing control 616 for controlling the shearing of the shear ring, and running control 618 for controlling the running of one or more of the setting tool, running tool, upper packer, seal stinger, and lower packer downhole. The network interface 610 may be a wired or wireless interface for sending commands to apparatus such as the braided wire and/or e-line to lower the components of the straddle assembly into the wellbore and to cause the ram of the setting tool to extend for applying the downward force. The bus 612 (e.g., PCI, ISA, PCI-Express etc.) facilitates communication by the various components of the computer system 600 to perform the functions described herein.

The computer system 600 may implement any one of the previously described functionalities partially (or entirely) in hardware and/or software (e.g., computer code, program code, program instructions) stored on a non-transitory machine readable medium/media. In some instances, the software is executed by the processor 602. Further, realizations can include fewer or additional components not illustrated in FIG. 6 (e.g., video cards, audio cards, additional network interfaces, peripheral devices, etc.). The processor 602 and the memory 604 are coupled to the bus 612. Although illustrated as being coupled to the bus 612, the memory 604 can be coupled to the processor 602.

Examples described above relate to forming a straddle assembly in a casing of a wellbore. In other examples, the straddle assembly may be formed within a tubing that is positioned concentric within a casing. The tubing may also carry hydrocarbons in a manner similar to how the casing carries hydrocarbons and be damaged, resulting in a need to bypass the damaged area with the straddle assembly. The straddle assembly may be positioned in other structures as well.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. For example, the operations depicted in blocks 502-524 can be performed in parallel or concurrently. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine readable medium may be a machine readable signal medium or a machine readable storage medium. A machine readable storage medium may be, for example, but not limited to, a system, apparatus, or device, that employs any one of or combination of non-transitory electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine readable storage medium may be any tangible medium that can contain, or store a program for use by or in connection with an instruction execution system, apparatus, or device. A machine readable storage medium is not a machine readable signal medium.

A machine readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine readable signal medium may be any machine readable medium that is not a machine readable storage medium and that can communicate, propagate, or transport a program for use by or in connection with an instruction execution system, apparatus, or device.

Program code embodied on a machine readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

While the aspects of the disclosure are described with reference to various implementations and exploitations, it will be understood that these aspects are illustrative and that the scope of the claims is not limited to them. In general, techniques for insertion of a seal stinger into a packer positioned in a wellbore to facilitate isolation of a zone within the wellbore. as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

EXAMPLE EMBODIMENTS

Example embodiments include the following:

Embodiment 1: A method for positioning a straddle assembly in a wellbore, the method comprising: positioning a lower packer, seal stinger, upper packer, running tool, and setting tool in the wellbore; setting the lower packer in the wellbore; applying, by the setting tool, a force which causes the seal stinger to be pushed into a seal receptacle of the lower packer, wherein the seal stinger is pushed into the seal receptacle by the setting tool pushing the running tool which causes the upper packer to be pushed, wherein the pushing of the upper packer causes the seal stinger to be pushed into the seal receptacle; applying, by an internal rod of the setting tool, a force to pull the running tool which causes the running tool to hold the lower packer in place while the seal stinger is pushed into the seal receptacle; and removing the running tool and setting tool from the wellbore, wherein the lower packer, seal stinger, and upper packer comprise the straddle assembly.

Embodiment 2: The method of Embodiment 1, further comprising anchoring the running tool to the lower packer to via a latch on the running tool and a shoulder on the lower packer, wherein the force to pull the running tool which causes the lower packer to be held is based on the anchoring of the running tool to the lower packer.

Embodiment 3: The method of Embodiment 1 or 2, further comprising applying a shearing force to a shear ring which disengages the anchor from the shoulder after the seal stinger is seated in the seal receptacle.

Embodiment 4: The method of any one of Embodiments 1-3, wherein applying, by the setting tool, the force comprises extending a ram of the setting tool which causes the seal stinger to be pushed into the seal receptacle.

Embodiment 5: The method of any one of Embodiments 1-4, wherein the force to pull the running tool is caused by the force which causes the seal stinger to be pushed into the seal receptacle.

Embodiment 6: The method of any one of Embodiments 1-5, wherein applying, by the internal rod of the setting tool, the force to comprises pulling an internal rod of the running tool coupled to the internal rod of the setting tool which causes the lower packer to be held in place as the seal stinger is pushed into the seal receptacle.

Embodiment 7: The method of any one of Embodiments 1-6, wherein the straddle assembly straddles a zone of the wellbore which is damaged.

Embodiment 8: The method of any one of Embodiments 1-7, further comprising flowing hydrocarbon through the lower packer, seal stinger, and upper packer.

Embodiment 9: The method of any one of Embodiments 1-8, wherein one or more of the lower packer, upper packer, seal stinger, setting tool and running tool are positioned in the wellbore via an e-line or braided wire.

Embodiment 10: The method of any one of Embodiments 1-9, wherein the seal stinger is pushed into the seal receptacle and the upper packer is positioned in the wellbore in a single extension of a ram of the setting tool.

Embodiment 11: A straddle assembly comprising: a running tool having a latch on a first internal rod; a seal stinger, wherein the seal stinger is a hollow conduit having a leading edge arranged with one or more o-rings; a lower packer set in a wellbore, the lower packer having a shoulder coupled to the latch on the first internal rod of the running tool and a seal receptacle inside which is the seal stinger, wherein the latch coupled to the shoulder anchors the running tool to the lower packer, and wherein the one or more o-rings forms a seal between the seal stinger and the seal receptacle; a setting tool having a ram and second internal rod, the second internal rod coupled to the first internal rod, wherein extension of the ram causes the second internal rod to pull the first internal rod to hold the lower packer in place.

Embodiment 12: The straddle assembly of Embodiment 11, further comprising a shear ring positioned around the first internal rod, the shear ring arranged to shear to disengage the latch from the shoulder.

Embodiment 13: The straddle assembly of Embodiment 11 or 12, wherein a single extension of a ram of the setting tool pushes the seal stinger into the seal receptacle and positions the upper packer in the wellbore.

Embodiment 14: The straddle assembly of any one of Embodiments 11 to 13, further comprising an upper packer at an opposite end of the leading edge of the seal stinger.

Embodiment 15: The straddle assembly of any one of Embodiments 11 to 14, wherein the lower packer, seal stinger, and upper packer define a conduit for flowing hydrocarbon.

Embodiment 16: A non-transitory machine readable medium containing program instructions stored in memory and executable by a processor to perform the functions of: positioning a lower packer, seal stinger, upper packer, running tool, and setting tool in a wellbore; setting the lower packer in the wellbore; applying, by the setting tool, a force which causes the seal stinger to be pushed into a seal receptacle of the lower packer, wherein the seal stinger is pushed into the seal receptacle by the setting tool pushing the running tool which causes the upper packer to be pushed, wherein the pushing of the upper packer causes the seal stinger to be pushed into the seal receptacle; applying, by an internal rod of the setting tool, a force to pull the miming tool which causes the running tool to hold the lower packer in place while the seal stinger is pushed into the seal receptacle; and removing the running tool and setting tool from the wellbore, wherein the lower packer, seal stinger, and upper packer comprise a straddle assembly.

Embodiment 17: The non-transitory machine readable medium of Embodiment 16, further comprising program instructions to cause the running tool to be anchored to the lower packer to via a latch on an internal rod of the running tool and a shoulder on the lower packer to hold the lower packer in place.

Embodiment 18: The non-transitory machine readable medium of Embodiment 16 or 17, further comprising program instructions to cause a shear ring to be sheared, wherein the shearing facilitates removal of the running tool and setting tool from the wellbore.

Embodiment 19: The non-transitory machine readable medium of any one of Embodiments 16 to 18, wherein the program instructions to apply, by the setting tool, the force comprises program instructions to cause a ram of the setting tool to be extended which causes the seal stinger to be pushed into the seal receptacle.

Embodiment 20: The non-transitory machine readable medium of any one of Embodiments 16 to 19, wherein the program instructions to apply, by the internal rod of the setting tool, the force comprises program instructions to pull an internal rod of the running tool coupled to the internal rod of the setting tool which causes the lower packer to be held in place as the seal stinger is pushed into the seal receptacle.

What is claimed is:

1. A method for positioning a straddle assembly in a wellbore, the method comprising:

positioning a lower packer, seal stinger, upper packer, running tool, and setting tool in the wellbore;

setting the lower packer in the wellbore;

applying, by the setting tool, a force which causes the seal stinger to be pushed into a seal receptacle of the lower packer, wherein the seal stinger is pushed into the seal receptacle by the setting tool pushing the running tool which causes the upper packer to be pushed, wherein the pushing of the upper packer causes the seal stinger to be pushed into the seal receptacle;

applying, by an internal rod of the setting tool, a force to pull the miming tool which causes the running tool to hold the lower packer in place while the seal stinger is pushed into the seal receptacle; and removing the running tool and setting tool from the wellbore, wherein the lower packer, seal stinger, and upper packer comprise the straddle assembly.

2. The method of claim 1, further comprising anchoring the running tool to the lower packer to via a latch on the running tool and a shoulder on the lower packer, wherein the force to pull the running tool which causes the lower packer to be held is based on the anchoring of the running tool to the lower packer.

3. The method of claim 2, further comprising applying a shearing force to a shear ring which disengages the latch from the shoulder after the seal stinger is seated in the seal receptacle.

4. The method of claim 1, wherein applying, by the setting tool, the force comprises extending a ram of the setting tool which causes the seal stinger to be pushed into the seal receptacle.

5. The method of claim 4, wherein the force to pull the running tool is caused by the force which causes the seal stinger to be pushed into the seal receptacle.

6. The method of claim 5, wherein applying, by the internal rod of the setting tool, the force to comprises pulling an internal rod of the running tool coupled to the internal rod of the setting tool which causes the lower packer to be held in place as the seal stinger is pushed into the seal receptacle.

7. The method of claim 1, wherein the straddle assembly straddles a zone of the wellbore which is damaged.

8. The method of claim 1, further comprising flowing hydrocarbon through the lower packer, seal stinger, and upper packer.

9. The method of claim 1, wherein one or more of the lower packer, upper packer, seal stinger, setting tool and running tool are positioned in the wellbore via an e-line or braided wire.

10. The method of claim 1, wherein the seal stinger is pushed into the seal receptacle and the upper packer is positioned in the wellbore in a single extension of a ram of the setting tool.

11. A straddle assembly comprising:

a running tool having a latch on a first internal rod;

a seal stinger, wherein the seal stinger is a hollow conduit having a leading edge arranged with one or more o-rings;

a lower packer set in a wellbore, the lower packer having a shoulder coupled to the latch on the first internal rod of the running tool and a seal receptacle inside which is the seal stinger, wherein the latch coupled to the shoulder anchors the running tool to the lower packer, and wherein the one or more o-rings forms a seal between the seal stinger and the seal receptacle;

a setting tool having a ram and second internal rod, the second internal rod coupled to the first internal rod, wherein extension of the ram causes the second internal rod to pull the first internal rod to hold the lower packer in place.

12. The straddle assembly of claim 11, further comprising a shear ring positioned around the first internal rod, the shear ring arranged to shear to disengage the latch from the shoulder.

13. The straddle assembly of claim 11, wherein a single extension of a ram of the setting tool pushes the seal stinger into the seal receptacle and positions an upper packer in the wellbore.

14. The straddle assembly of claim 11, further comprising an upper packer at an opposite end of the leading edge of the seal stinger.

15. The straddle assembly of claim 14, wherein the lower packer, seal stinger, and upper packer define a conduit for flowing hydrocarbon.

16. A non-transitory machine readable medium containing program instructions stored in memory and executable by a processor to perform the functions of:

positioning a lower packer, seal stinger, upper packer, running tool, and setting tool in a wellbore;

setting the lower packer in the wellbore;

applying, by the setting tool, a force which causes the seal stinger to be pushed into a seal receptacle of the lower packer, wherein the seal stinger is pushed into the seal receptacle by the setting tool pushing the running tool which causes the upper packer to be pushed, wherein the pushing of the upper packer causes the seal stinger to be pushed into the seal receptacle;

applying, by an internal rod of the setting tool, a force to pull the running tool which causes the running tool to hold the lower packer in place while the seal stinger is pushed into the seal receptacle; and removing the running tool and setting tool from the wellbore, wherein the lower packer, seal stinger, and upper packer comprise a straddle assembly.

17. The non-transitory machine readable medium of claim 16, further comprising program instructions to cause the running tool to be anchored to the lower packer to via a latch on an internal rod of the running tool and a shoulder on the lower packer to hold the lower packer in place.

18. The non-transitory machine readable medium of claim 16, further comprising program instructions to cause a shear ring to be sheared, wherein the shearing facilitates removal of the running tool and setting tool from the wellbore.

19. The non-transitory machine readable medium of claim 16, wherein the program instructions to apply, by the setting tool, the force comprises program instructions to cause a ram of the setting tool to be extended which causes the seal stinger to be pushed into the seal receptacle.

20. The non-transitory machine readable medium of claim 16, wherein the program instructions to apply, by the internal rod of the setting tool, the force comprises program instructions to pull an internal rod of the running tool coupled to the internal rod of the setting tool which causes the lower packer to be held in place as the seal stinger is pushed into the seal receptacle.

* * * * *